US005272971A

United States Patent [19]

Fredericks

[11] Patent Number: 5,272,971

[45] Date of Patent: Dec. 28, 1993

[54] INK TEMPERATURE CONTROL SYSTEM FOR WATERLESS LITHOGRAPHIC PRINTING

[75] Inventor: Guenther Fredericks, Mt. Prospect, Ill.

[73] Assignee: Electro Sprayer Systems, Inc., Elk Grove Village, Ill.

[21] Appl. No.: 929,984

[22] Filed: Aug. 14, 1992

[51] Int. Cl.[5] ..... B41F 7/02; B41F 31/02

[52] U.S. Cl. ..... 101/136; 101/350

[58] Field of Search ..... 101/350, 363, 364, 148, 101/487, 136, 137, 138, 141, 142, 207-210, 488, 484; 210/175; 237/2 R

[56] References Cited

U.S. PATENT DOCUMENTS 4,879,951 1/1989 Yoshida ..... 101/363

FOREIGN PATENT DOCUMENTS 21453 1/1991 Japan ..... 101/487
21455 1/1991 Japan ..... 101/487
14452 1/1992 Japan ..... 101/487

*Primary Examiner*—J. Reed Fisher
*Attorney, Agent, or Firm*—Hill, Steadman & Simpson

[57] ABSTRACT

A temperature regulation system for a lithographic press, usually of the type using a waterless plate, used to control ink temperature at application to a substrate to be printed. The system includes a contactless sensor for sensing ink temperature between the ink distribution system and application to a substrate and for operating a temperature regulation system that controls the temperature of regulatable rolls in the ink path and thus the sensed ink temperature. This regulation system includes a refrigeration circuit, a secondary heater circuit for obtaining hot fluid, a reservoir for cold fluid and a mixing valve. This system is energy efficient, variable and responsive. It has been found that using this system the ink temperature can be very accurately controlled. Usually the system is used with a waterless plate and it has been found that commercially available lithographic inks as well as the special waterless inks can be used.

10 Claims, 2 Drawing Sheets

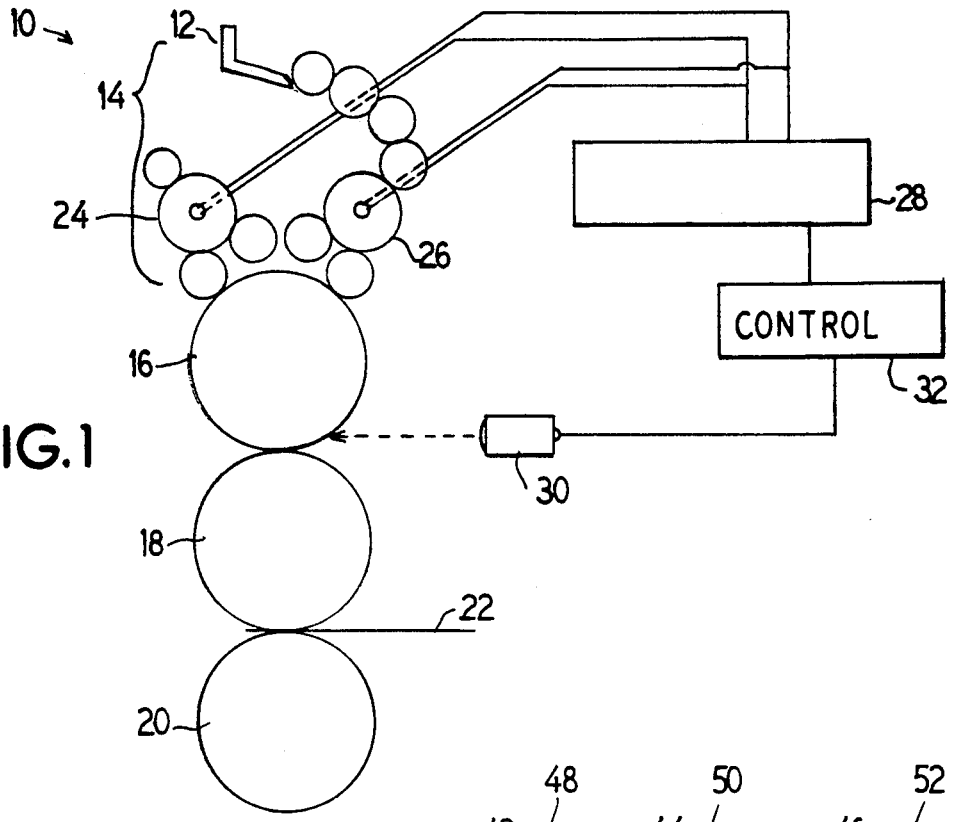
FIG.1
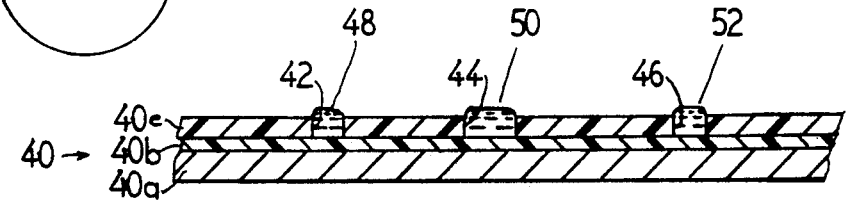
FIG.2
FIG.3
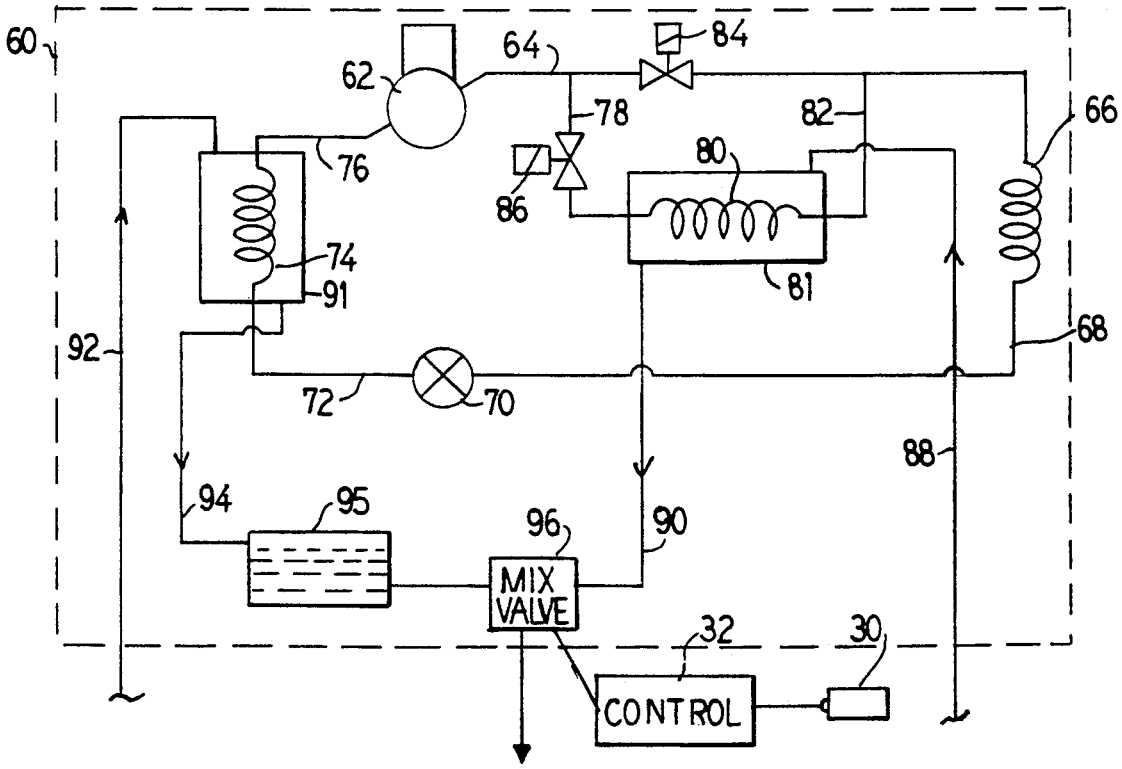

INK TEMPERATURE CONTROL SYSTEM FOR WATERLESS LITHOGRAPHIC PRINTING

BACKGROUND OF THE INVENTION

This invention relates to printing and, in particular, to the process of offset printing where waterless lithographic plates may be used.

There are many different types of printing, but one of the more popular processes is known as offset lithography where a plate having inked image areas and ink repelling (i.e., non-inked) non-image areas is used. The non-image areas are treated with water using a system of dampening rolls, and the water repels the ink so as to form the non-inked area. The ink is distributed to the plate cylinder via its own set of rollers that define an inking system which break down, vibrate and generally distribute the ink.

Recently a waterless silicone plate has been developed for use in offset systems and as a substitute for the water-based system (i.e., eliminates the use of the dampening system). The plate defines a series of ink-receiving wells or impressions that define the imaging area and the non-imaging area is defined by a silicone rubber layer between the ink receiving imaging areas. The silicone rubber repels the ink and thus only the inked areas are the image areas.

In water-based systems, water or a water-alcohol solution (sometimes substitutes are provided for the alcohol and other additives such as ethylene glycol may be used) is used to provide the ink repelling non-imaging area. The water and alcohol also provide some temperature control for the printing process in general and the ink specifically. In order to function properly, when the ink is applied, usually by the blanket cylinder to the substrate, the ink must be held within a predetermined temperature range.

Thus it is an object of this invention to provide a temperature regulation system for use in a press using a waterless plate to maintain the ink temperature, particularly at the time and place of application, within a predetermined temperature range.

Regular commercially available lithographic inks are used in the water-based system, but more expensive and specially compounded inks are provided for in the waterless system.

Moreover, a plurality of inks of different colors may be used, each requiring maintenance within its own predetermined temperature range and each temperature range may be different.

Thus it is another object of this invention to provide a temperature regulation system for use in a press using a waterless plate to maintain the temperature of each ink within the ink's predetermined operating temperature range.

Current offset presses utilize a cooling or refrigeration system and heater or Kcal rods associated with inking rolls, usually the vibrator rolls, for controlling the temperature of the rolls. This system has been found not to provide an effective system, particularly for use in a waterless system as it operates only at a discrete high temperature and a discrete low temperature and not continuously therebetween. Moreover, the response time or the rate at which the system can adjust to a temperature can be prolonged, particularly as the prior art system uses heating rods to raise the temperature of the temperature regulating fluid flowing to ink rolls. Furthermore, the use of Kcal rods can be very consumptive of energy. All of these deficiencies can affect the ultimate printed product.

Thus it is yet another object of this invention to provide a temperature regulating system for use with an offset press, particularly using a waterless plate so as to effectively control ink temperature and overcome problems of the prior system.

At present there is a significant installed base of water-based offset lithographic systems. Thus, it is anticipated that water-based offset lithographic systems will continue to be used in significant numbers. Thus sometimes a press may selectively be used for water-based or waterless printing.

Thus it is an object of this invention to utilize the temperature regulation system developed for the waterless system also with water-based systems.

These and other objects of this invention will become apparent from the following disclosure and appended claims.

SUMMARY OF THE INVENTION

This invention provides an ink temperature-regulation system for a waterless lithographic printing system. The system senses the ink temperature between the inking system and application to a substrate and adjusts the temperature of water being delivered to vibrator rolls in the ink path which in turn affects the ink temperature to control it to within a predetermined range. The temperature of the regulating water is adjusted using a heat exchanger, reservoir and mixing valve system in a refrigeration system. Moreover, this system is adapted to be used to regulate the temperature of a single ink or a plurality of inks. Furthermore, it has been found that the temperature regulation system can be used with either the waterless type or water-type presses.

Finally, it has been found that accurate temperature regulation permits regular commercial inks to be used in the waterless system.

BRIEF DESCRIPTION OF THE DRAWINGS

FIG. 1 is a diagrammatic end view showing a lithographic press using a waterless plate for printing and the temperature regulating system of the invention;

FIG. 2 is a vertical sectional view showing a waterless type silicone plate as used in this invention;

FIG. 3 is a diagrammatic view showing components of the temperature regulating system used in this invention;

DESCRIPTION OF THE PREFERRED EMBODIMENT

In General

Figure 4:
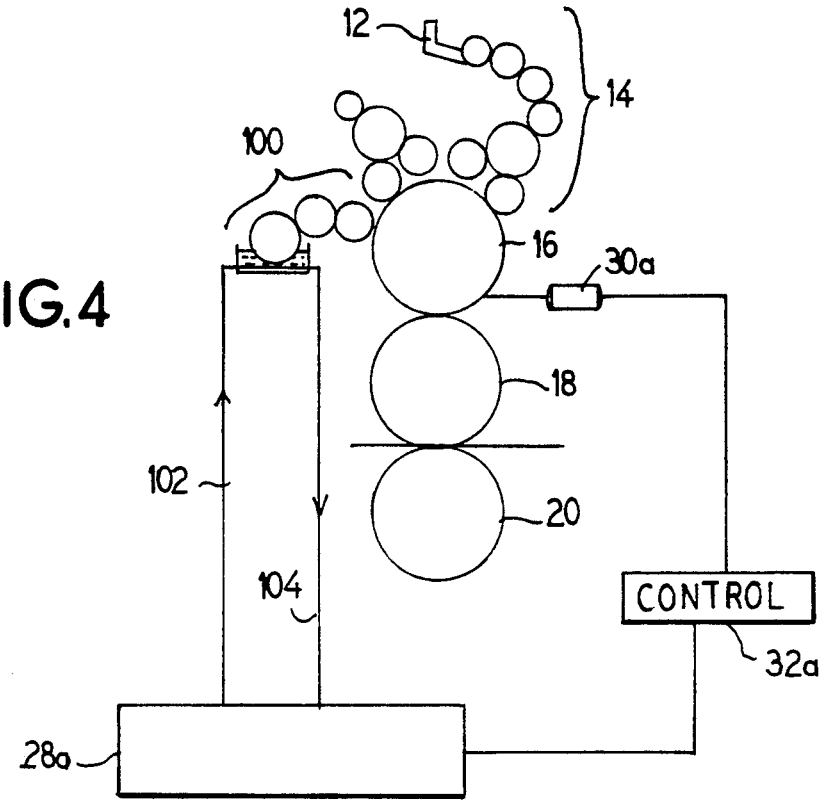
FIG. 4 is a diagrammatic view showing the ink temperature regulating system as adapted for use with a water-based system.

Referring first to FIG. 1, there is shown a diagrammatic view of an offset-style press. In general, the press 10 includes an ink fountain 12, an ink distribution system 14 (which includes a plurality of rollers), a plate cylinder 16, a blanket cylinder 18, and an impression cylinder 20. A substrate 22 which is to be printed passes between the blanket cylinder and the impression cylinder.

The ink system includes several rollers intended to break up and distribute the ink for even application and distribution onto the plate cylinder 16. Included within the ink distribution rollers are vibrator rollers 24 and 26, which are adapted to control the temperature of ink in contact therewith, constructed to carry a temperature regulating fluid therethrough, and are usually copper clad so as to help control the temperature throughout the roll.

The refrigeration system is generally shown as 28 and is interconnected with the vibrator rolls 24 and 26 in the ink system. A contactless sensor 30 of the infrared type, available from Raytek, Santa Cruz, Calif., senses the ink temperature on the surface of the plate cylinder 16. The sensor is connected to a control system 32 of the PID (proportional integral derivative) type available from Allen-Bradley Co. of Milwaukee, Wis., controls a mixing valve and heat exchanger in the refrigeration system, and thus adjusts the operation of the temperature regulation system and flow to the vibrator rolls 24 and 26 as a function of the temperature sensed by sensor 30. The sensor in a contactless manner senses the temperature of the ink on the plate cylinder. The ink at the time of application is intended to be within a critical temperature range, for example between 70° F. and 80° F. Suitable inks can be purchased from Sun Chemical or Dainippon Ink.

The Plate

The system as shown in FIG. 1 is generally known as a waterless system. In that system the plate 40, as shown in FIG. 2, is a silicone plate which has therein a series of depressions such as 42, 44 and 46 which are constructed to receive ink such as 48, 50 and 52, so as to form the image areas. The plate includes an aluminum layer 40*a*, a photo polymer layer 40*b*, and the silicone layer 40*c*. The areas between the depressions are generally known as the non-imaging areas and the imaging areas are identified as the areas which include ink. A manufacturer of such a plate is Toray Industries, Inc., 8-1, Mihama 1-chome, Urayasu, Chiba 279 Japan.

This type of flexible plate 40 is mounted to the plate cylinder 16. In order to control the temperature of the ink, the temperature of the vibrating rolls is controlled by using temperature regulated water from a refrigeration system, such as 28 generally, in connection with the control 32 and sensor 30.

The Temperature Regulation System

The temperature regulation system 28 in FIG. 1 and 60 in FIG. 3 includes the components shown in FIG. 3. The system of FIG. 3 includes a primary refrigeration circuit having a compressor 62, a line 64 which leads to a condenser coil 66, a line 68 from the condenser coil connects to an expansion valve 70, then via line 72 to an evaporation coil 74, and a line 76 leading from the evaporation coil back to the condenser. A standard refrigerant is used in this system.

A secondary circuit for providing heated water is provided between the compressor 62 and the condensing coil 66 and generally includes a line 78 leading to a coil 80 and return line 82. A set of solenoid valves 84 and 86 are employed to direct flow of refrigerant.

In general the refrigerant flowing from the compressor through the compressor coil to the expansion valve can be considered to be hot, whereas the refrigerant flowing from the evaporation coil and back to the compressor can be considered to be cold.

A first heat exchanger 81 is provided about the coil 80 and a water in-flow line 88 and a water out-flow line 90 are provided. A second heat exchanger 91 is provided about the evaporation coil 74 and in there a water in-flow line 92 is provided as well as a water out-flow line 94. Using this system, hot water can be obtained from the secondary coil 80 via the heat exchanger 81 and flow from line 90 to a mixing valve 96. Similarly, cold water can be obtained from line 94 and flow to a reservoir or holding tank 95 and then also flow to the mixing valve 96. From the mixing valve 96 temperature regulated water flows to the respective vibrator rolls and back from those rolls to the heat exchanger circuits. Return water is then recycled through the heat exchangers so as to be heated or cooled as may be necessary.

Water-Based Systems

In another embodiment, many presses are already of the water type and include a dampening or water section 100 as shown in FIG. 4. The presses may be selectively operated in both the water-based or waterless mode as by removal of one of the dampening rolls. In the water-based system the temperature of the ink is sensed with sensor 30*a*, control 32*a* is used and the temperature regulation system 28*a* as previously described is used. However, since this type of press includes a dampening system the temperature of the water used in the dampening system 100 is adjusted in response to the ink temperature. In this manner regulated water flows from the regulation system 28 via line 102 to the dampening system and excess water is returned via line 104. Thus this system can be useful in both the water and waterless types, and dependent upon which type is being used, appropriate adjustments can be made. More specifically temperature regulated water is delivered to the dampening rolls for distribution. Overflow and return water then returns to the system.

Multiple Color Systems and Inks

Figure 5:
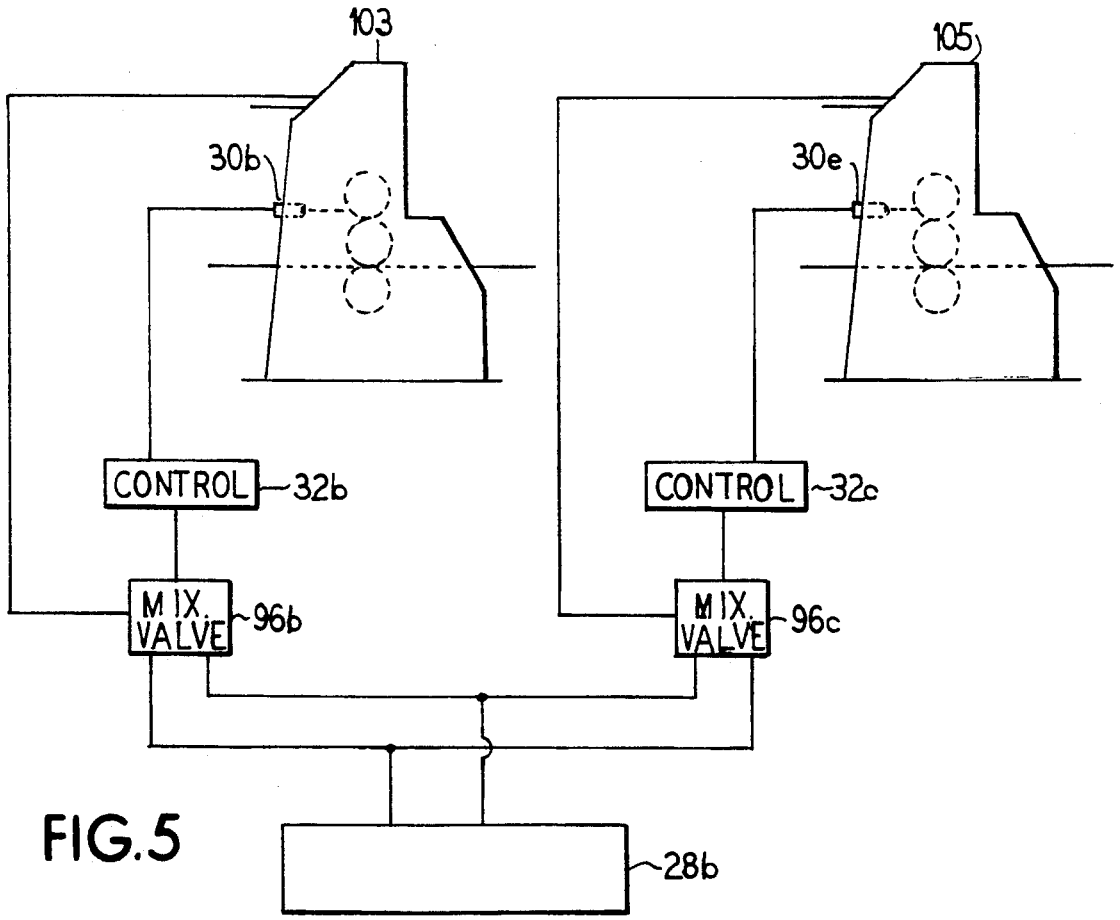
FIG. 5 is a diagrammatic view of system which employs the use of plurality of inks.

Referring to FIG. 5, a multiple color system is represented, which includes multiple stations for printing with different color inks. In such systems a plurality (two or more) of inks are used. For example, one part of the press uses a first colored ink station 103 and another part of the press uses a second colored ink station 105. In that case, separate sensors 30*b* and 30*c* and controls 32*b* and 32*c* are used to control mixing valves 96*b* and 96*c* so that the temperature for each ink is adjusted independently. The temperature regulation system 32*b* is of the type shown in FIG. 3 so that an appropriate reservoir system and heat exchanger system are used.

It is known that each ink has its own temperature characteristics and it is thus desirable to control the temperature of each ink independently so as to get maximum performance from the ink.

It has been discovered that with accurate ink temperature sensing and adjusting, ordinary commercial lithographic ink can be used with a waterless plate and satisfactory images can be produced. The use of commercially available inks and a waterless plate should result in lower operation costs and improved printing. As set out above, water-based or waterless inks can be purchased commercially from companies such as Sun Chemical or Dainippon Ink.

Operation

When using a waterless plate such as 40 mounted to a plate cylinder 16, ink is loaded into the reservoir 12. Inks specially compounded for waterless operation can be used, but commercially available lithographic ink (inks which may have been compounded for water-based operation) may also be used. The ink is then broken up, spread and distributed by the rollers in the ink path. This can be necessary as an ink's physical properties such as tack (or stickiness) and viscosity can vary.

The ink passes to the temperature regulating vibrator rolls at which the ink temperature can be adjusted. From the ink path, the ink flows to the large diameter plate cylinder 16 for imaging. Then the image is transferred to the blanket cylinder and then to the substrate. The impression cylinder 20 backs up the blanket cylinder 18 and forms the nip through which the substrate passes.

The sensor 30 senses the ink temperature at the plate cylinder surface. Because of the relative size of the ink path, rollers and plate and blanket cylinder sensing can be accomplished at a point between ink path rollers and ultimate application to the substrate.

If the ink temperature is within the critical range for operation, then the sensor does not signal the temperature regulation system for operation. On the other hand if the sensed temperature is too low or too high, the temperature regulation system and mixing valve are signalled for operation. Cold water can be drawn immediately from the reservoir 95 and the hot water heat exchanger 81 can be activated by operation of the solenoid valves 84 and 86. The mixing valve provides almost immediate response and provides water at the proper temperature for regulation. This temperature regulating water is delivered to the vibrator rolls and the ink temperature is adjusted until the sensed ink temperature is within the critical range.

Using this system, it can be seen that temperature regulation is substantially continuous, rapid and energy efficient.

A system that is water-based and uses dampening rolls operates so as to adjust the temperature of the dampening solution, usually water and alcohol, so that the delivered water-alcohol are at the desired temperature. Similar presses, sensors, controls and temperature regulating systems are used as described hereinbefore.

Although the invention has been described with respect to a preferred embodiment, changes and modifications can be made which are within the spirit and scope of the invention.

I claim as my invention:

1. An ink temperature regulation system comprising an offset type lithographic press which includes an ink reservoir, a plurality of ink distribution rollers associated with the ink reservoir, a plate cylinder constructed to carry a lithographic image plate and to receive ink from the ink rollers, a blanket cylinder associated with plate cylinder and an impression cylinder associated with the blanket cylinder so that a substrate to be printed passes between the blanket cylinder and impression cylinder to receive the inked images, wherein the ink temperature regulation system includes:

a sensor for sensing the temperature of ink at a position between the ink rolls and application to substrate, and a control system for receiving a signal corresponding to the sensed temperature and controlling the operation of the temperature regulating system to maintain the ink temperature within the predetermined range, and a temperature regulation system operatively associated with at least one of the ink distribution rollers and the sensor so as to adjust the temperature of the ink distribution rolls so as to obtain a desired ink temperature within a predetermined range at application; and wherein the temperature regulation system includes a refrigeration system having:

a primary refrigeration circuit which includes a compressor, a condenser coil, an expansion valve and an evaporation coil;

a secondary heat exchange circuit positioned between the compressor and the condenser coil having an input associated with the compressor output and a coil for use as part of a heat exchanger and an output associated with the condenser coil input;

a first heat exchanger associated with the secondary circuit coil whereby a fluid passes through the heat exchanger and receives heat from the secondary coil;

a second heat exchanger associated with the evaporator coil whereby a fluid passing through the heat exchanger is cooled;

a reservoir associated with the output of the second heat exchanger to receive and accumulate cooled water; and mixing means for receiving and mixing output fluid from the reservoir and first heat exchanger so as to produce a combined fluid of a selected temperature and said mixing means operatively associated with the control means and constructed to deliver fluid to said temperature regulatable rollers in the ink system.

2. An ink temperature regulation system as in claim 1, wherein said press is adapted to print in a plurality of colors, each of which corresponds to an ink and each ink having a different operating temperature range and sensor means and control means associated with each ink and the temperature regulation system so as to maintain each ink at a temperature within the predetermined operating range for each ink.

3. An ink temperature regulation system as in claim 1, for use with a lithographic press constructed to be selectively operated as a waterless system or a water-based system, wherein in the water-based system includes a plurality of dampening rolls to move a water-based dampening solution from a reservoir to the plate cylinder wherein the water solution delivered to the reservoir is at a temperature controlled by the sensor and the temperature regulation system.

4. An ink temperature regulation system as in claim 1, wherein the image plate is of the waterless type.

5. An ink temperature regulation system as in claim 1, wherein the sensor is of the infrared type.

6. An ink temperature regulation system as in claim 1, wherein the sensor senses the ink temperature at the plate cylinder.

7. An ink temperature regulation system as in claim 1, wherein the sensor for sensing temperature is a contactless temperature sensor.

8. An ink temperature regulation system comprising a printing press which includes an ink reservoir for holding ink to be printed on a substrate, and a plurality of rollers between the reservoir and a substrate for distributing ink and applying ink to a substrate, with at least one of said rollers being temperature regulatable, wherein the ink temperature regulation system includes:

a temperature sensor for sensing the temperature of ink at a position between the ink reservoir and application to substrate and a control system for receiving a signal corresponding to the sensed temperature and controlling the operation of the temperature regulating system to maintain the ink temperature within the predetermined range; and a temperature regulation system operatively associated with at least one of the distribution rollers and the sensor so as to adjust the temperature of the rollers so as to obtain a desired ink temperature within a predetermined range at application;

wherein the temperature regulation system includes a refrigeration system having:

a primary refrigeration circuit which includes a compressor, a condenser coil, an expansion valve and an evaporation coil;

a secondary heat exchange circuit positioned between the compressor and the condenser coil having an input associated with the compressor output and a coil for use as part of a heat exchanger and an output associated with the condenser coil input;

a first heat exchanger associated with the secondary circuit coil whereby a fluid passes through the heat exchanger and receives heat from the secondary coil;

a second heat exchanger associated with the evaporator coil whereby a fluid passing through the heat exchanger is cooled;

a reservoir associated with the output of the second heat exchanger to receive and accumulate cooled water; and mixing means for receiving and mixing output fluid from the reservoir and first heat exchanger so as to produce a combined fluid of a selected temperature and said mixing means operatively associated with the control means and constructed to deliver fluid to said temperature regulatable rollers in the ink system.

9. An ink temperature regulation system as in claim 8, wherein the temperature sensor is of the contactless type.

10. An ink temperature regulation system as in claim 8, wherein the printing press if of the offset lithographic type and includes an image plate of the lithographic type.

* * * * *